US006109811A

United States Patent [19]

Song

[11] Patent Number: 6,109,811

[45] Date of Patent: Aug. 29, 2000

[54] MOP WITH CLEANING CLOTH

[76] Inventor: Young So Song, 5-103 Kaepo 1-cha Woosung Apt., 503, Daechi 1-dong, Kangnam-gu, Seoul, Rep. of Korea

[21] Appl. No.: 08/984,668

[22] Filed: Dec. 3, 1997

[30] Foreign Application Priority Data

Jul. 21, 1997 [KR] Rep. of Korea ..... 97-19145

[51] Int. Cl.[7] ..... A46B 11/06

[52] U.S. Cl. ..... 401/289; 401/281; 401/282; 15/230.14; 15/228

[58] Field of Search ..... 401/270, 281, 401/280, 275, 289, 290, 291, 261, 139, 130, 137, 43, 42, 266, 268, 282; 15/230.14, 229.2, 229.6, 229.8, 228, 97.1

[56] References Cited

U.S. PATENT DOCUMENTS

| | | | |
|---|---|---|---|
| 1,718,117 | 6/1929 | Dainos . | |
| 3,377,123 | 4/1968 | Leeson | 401/139 |
| 4,032,239 | 6/1977 | Maupin | 401/203 |
| 4,066,366 | 1/1978 | Reynolds | 401/285 |
| 4,971,471 | 11/1990 | Sloan | 401/203 |
| 5,784,748 | 7/1998 | Belanger et al. | 15/230.14 |
| 5,791,006 | 8/1998 | Anctil | 15/144.4 |

*Primary Examiner*—David J. Walczak

*Attorney, Agent, or Firm*—McAulay Nissen Goldberg Kiel & Hand, LLP

[57] ABSTRACT

An improved mop with a cleaning cloth which is capable of more effectively cleaning, elongating the life span of a mop, reducing water consumption for cleaning, more rapidly cleaning, and being well applicable to cleaning a car body or an outer wall of a building. The mop includes a plurality of mop rods, and a plurality of thin plate-shaped mop cloths which are stacked by a mop cloth assembling member.

13 Claims, 8 Drawing Sheets

MOP WITH CLEANING CLOTH

This application is based on Utility Model Application No. 97-19145 filed in Republic of Korea, the contents of which is incorporated hereinto by reference.

BACKGROUND OF THE INVENTION

1. Field of the Invention

The present invention relates to a mop with a cleaning cloth, and in particular, to an improved mop with a cleaning cloth which is capable of easily removing and cleaning foreign matters attached to a car body as to well as an outer wall of a building by connecting a water supply hose to a mop with a cleaning cloth, thus more effectively performing a cleaning operation of a mop.

2. Description of the Conventional Art

Generally, as shown in FIG. 1, a conventional mop designed for cleaning dusts, foreign matters, etc. includes a mop rod 100, and a cleaning cloth 200 formed of a plurality of pieces of cloth or silks or the like and fixed to one end of the mop rod 100.

However, the conventional mop has disadvantages in that since the cleaning cloth 200 is formed of a plurality of pieces of cloth or silks or the like, some of the pieces of the cloth or the silks may be easily detached or pulled out of the mop, thus staining the surface to be cleaned and shortening the life span of the mop.

Furthermore, when cleaning and removing foreign matters attached to or resting on a car body as a result of its own weight, an outer wall of a building, or an airplane body by using the conventional mop, since a user cleans the same with one hand holding the mop rod 100 and the other hand holding a water supply hose for spraying water to the wall to be cleaned, the user easily becomes tired. In addition, when the user sprays water onto a floor or a wall to be cleaned, thus staining the walls by a scattering of the water in which foreign matters mare contained. Furthermore, when water is scattered on wall areas which do not need cleaning, this increases a water consumption.

SUMMARY OF THE INVENTION

Accordingly, it is an object of the present invention to provide an improved mop with a cleaning cloth which overcomes the aforementioned problems encountered in the conventional art.

It is another object of the present invention to provide an improved mop with a cleaning cloth which is capable of easily removing and cleaning foreign matters attached to a resting on a car body as well as an outer wall of a building by connecting a water supply hose to a mop with a cleaning cloth, thus more effectively performing a cleaning operation of a mop.

It is another object of the present invention to provide an improved mop with a cleaning cloth which is capable of more effectively cleaning, elongating the life span of a mop, reducing water consumption for cleaning, more rapidly cleaning, and being well applicable to cleaning a car body or an outer wall of a building.

To achieve the above objects, there is provided an improved mop with a cleaning cloth which includes a plurality of mop rods, and a plurality of thin plate-shaped mop cloths which are stacked by a mop cloth assembling member.

The mop cloths are made of a synthetic material which is capable of cleaning and absorbing water, a hole through which water is supplied, is formed at a portion of each of the mop cloths, and an assembling hole is formed at a portion of each of the mop clothes for assembling the mop cloths, and radially arranged wings are formed in an outer circumferential surface thereof.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration, only, and thus are not limitative of the present invention, and wherein.

DETAILED DESCRIPTION OF THE INVENTION

Figure 1:
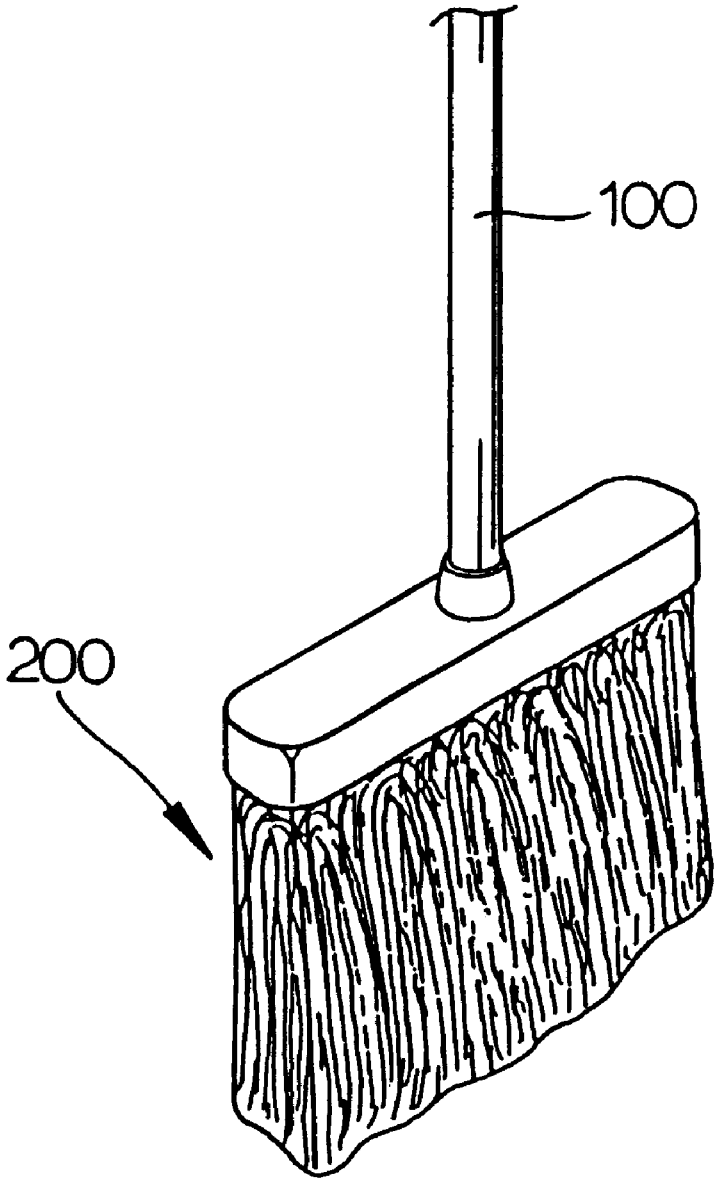
F I G. 1 PRIOR ART
FIG. 1 is a perspective view illustrating a conventional mop with a cleaning cloth.
Figure 2:
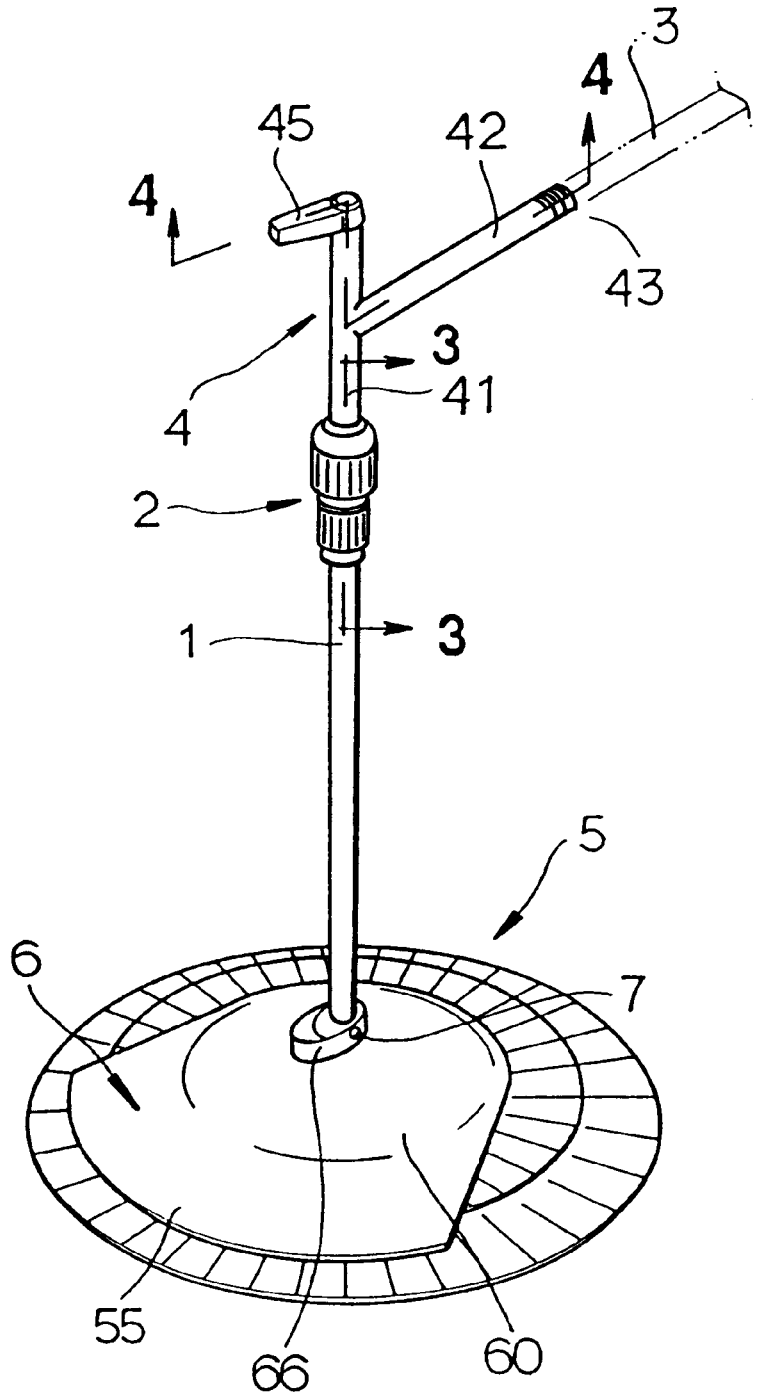
FIG. 2 is a perspective view illustrating an improved mop with a cleaning cloth according to the present invention.

FIG. 2 illustrates an improved mop with a cleaning cloth according to the present invention.

As shown therein, a telescoping mop rod 1 is formed to be hollow and is extendable by a plurality of individual component mop rods forming telescoping mop rod 1 and each component has a different diameter. Namely, the mop rod component is inserted into a corresponding mop rod component which is inserted into a corresponding mop rod component, thus extending the length of the telescoping mop rod 1.

Figure 6:
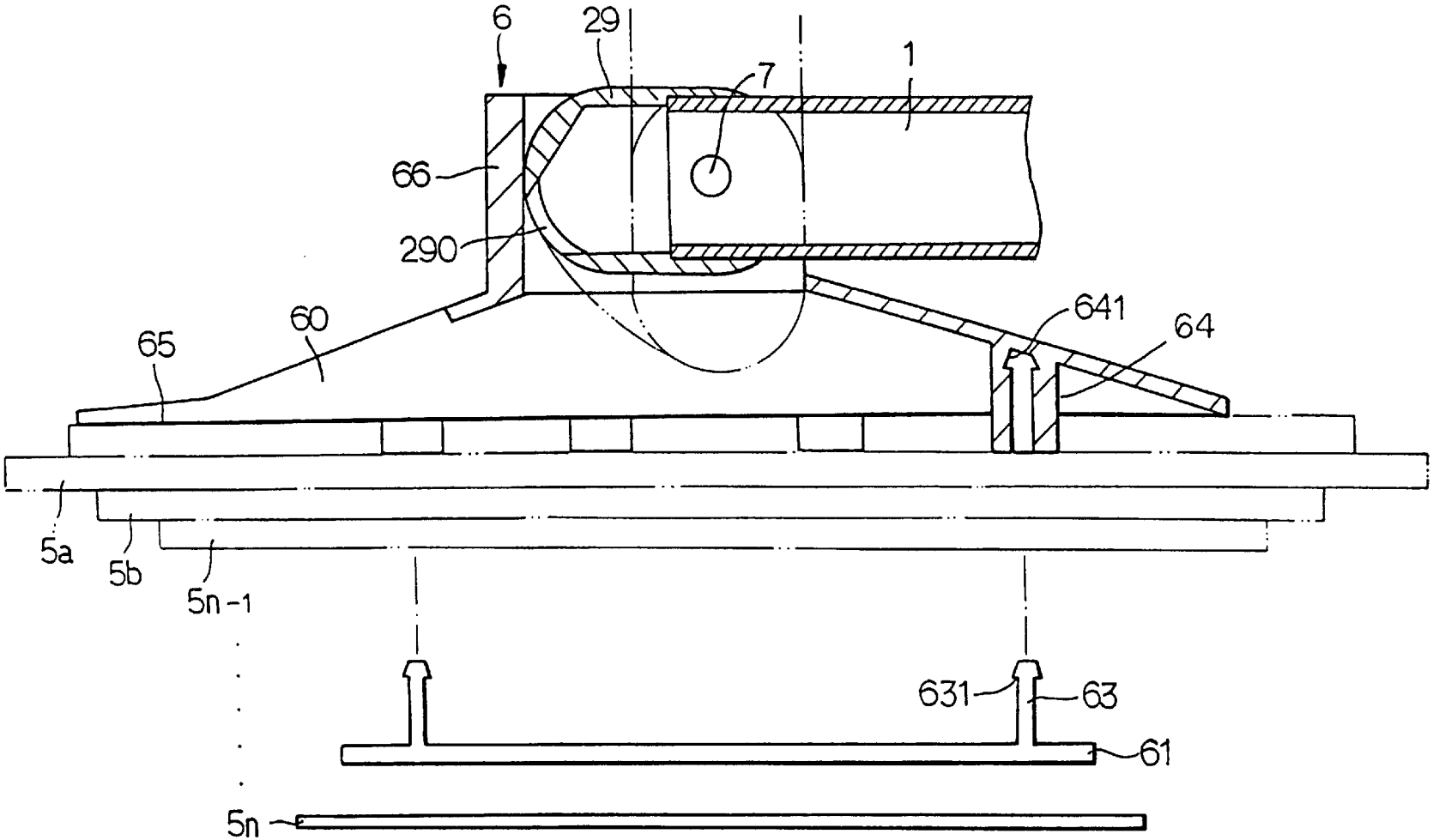
FIG. 6 is a cross-sectional view illustrating an improved mop according to the present invention.
Figure 7A:
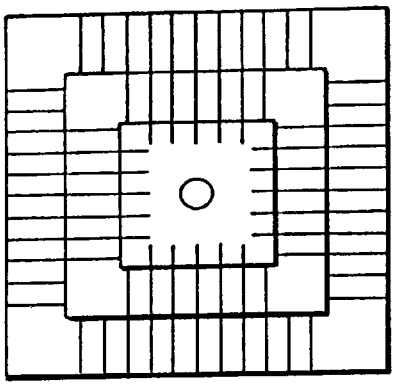
FIGS. 7A through 7C are plan views illustrating various cleaning cloths for an improved mop according to the present invention.
Figure 7B:
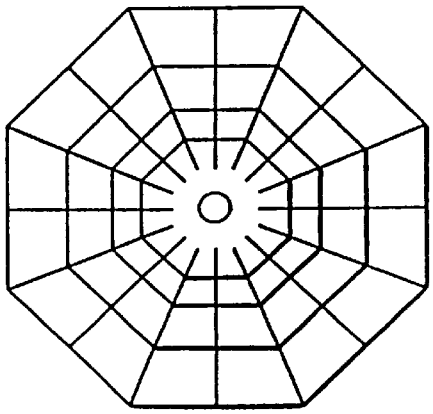
Figure 7C:
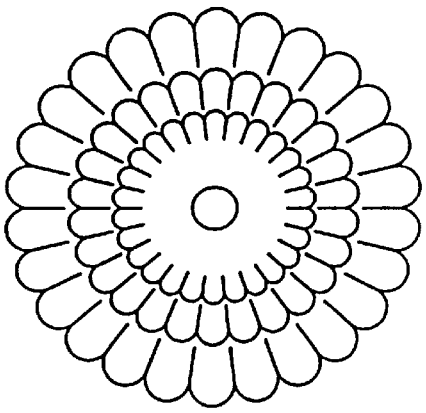

As shown in FIG. 6, a fixing member 29 is fixed to one end of the mop rod 1 and is provided with a discharge portion 290 through which water is supplied. In addition, the fixing member 29 is rotatable at a predetermined angle in a state that the same is fixed to a mop cloth assembling member 6 (see FIG. 2) together with the mop rod 1 with respect to a shaft pin 7 inserted into the mop cloth assembling member 6 and the fixing member 29.

Therefore, the water supplied into the interior of the mop rod 1 causes the mop rod 1 to rotate through an angle of 90°, so that even though a mop cloth 5 with wings 53 is substantially perpendicular to the mop rod 1 or the mop cloth 5 and the mop rod 1 are located at the same height, the water is always supplied into the interior of the mop cloth assembling member 6 and engages the wings 53 to cause the mop to rotate.

Figure 3:
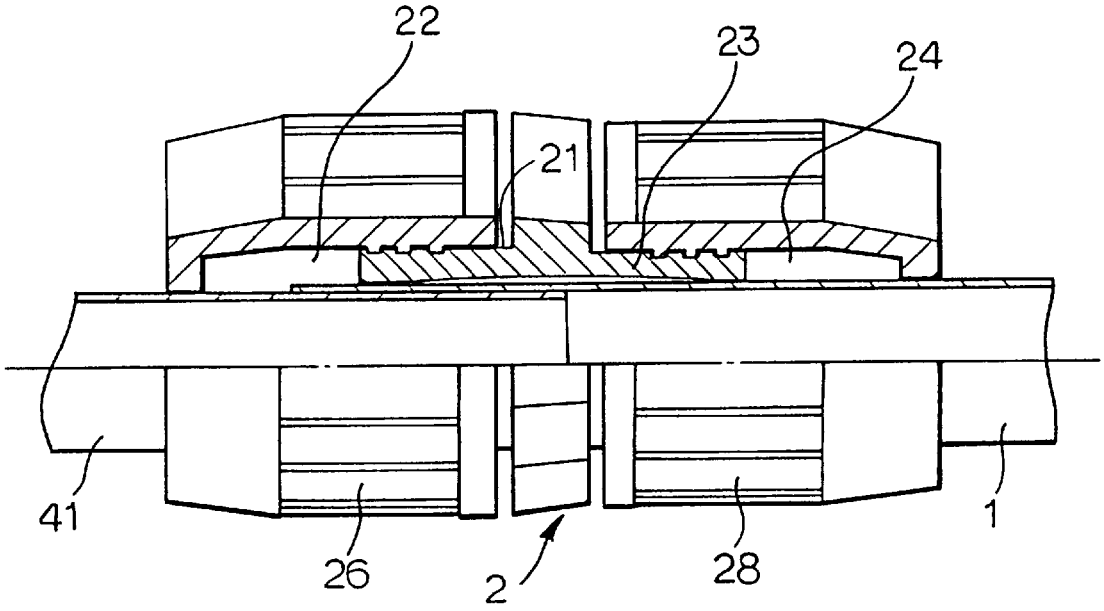
FIG. 3 is a cross-sectional view taken along line 3—3 of FIG. 2 illustrating a rod connection member for an improved mop with a cleaning cloth according to the present invention.

As shown in FIG. 3, the diameters of both ends of a mop rod connection member 2 are different, and the mop rod connection member 2 is formed to be hollow. In addition, slits 22 and 24 are formed by a cutter with a predetermined width inwardly from the ends of screw assembling-portions 21 and 23 formed at the both ends thereof, and the mop rod 1 is fixed with a corresponding mop rod by coupling portions 26 and 28 threadedly coupled by the screw assembling portions 21 and 23, thus obtaining a predetermined length of the mop rod 1.

The coupling portions 26 and 28 assembled to the screw assembling portions 21 and 23 include a taper, respectively, which is formed in a predetermined direction, thus increasing a coupling force of the coupling portions 26 and 28, whereby the end portions of the screw assembling portions 21 and 23 are formed to be inwardly narrowed, namely, the inner diameters thereof are decreased, thus fixing the mop rod 1 to a corresponding mop rod.

Figure 4:
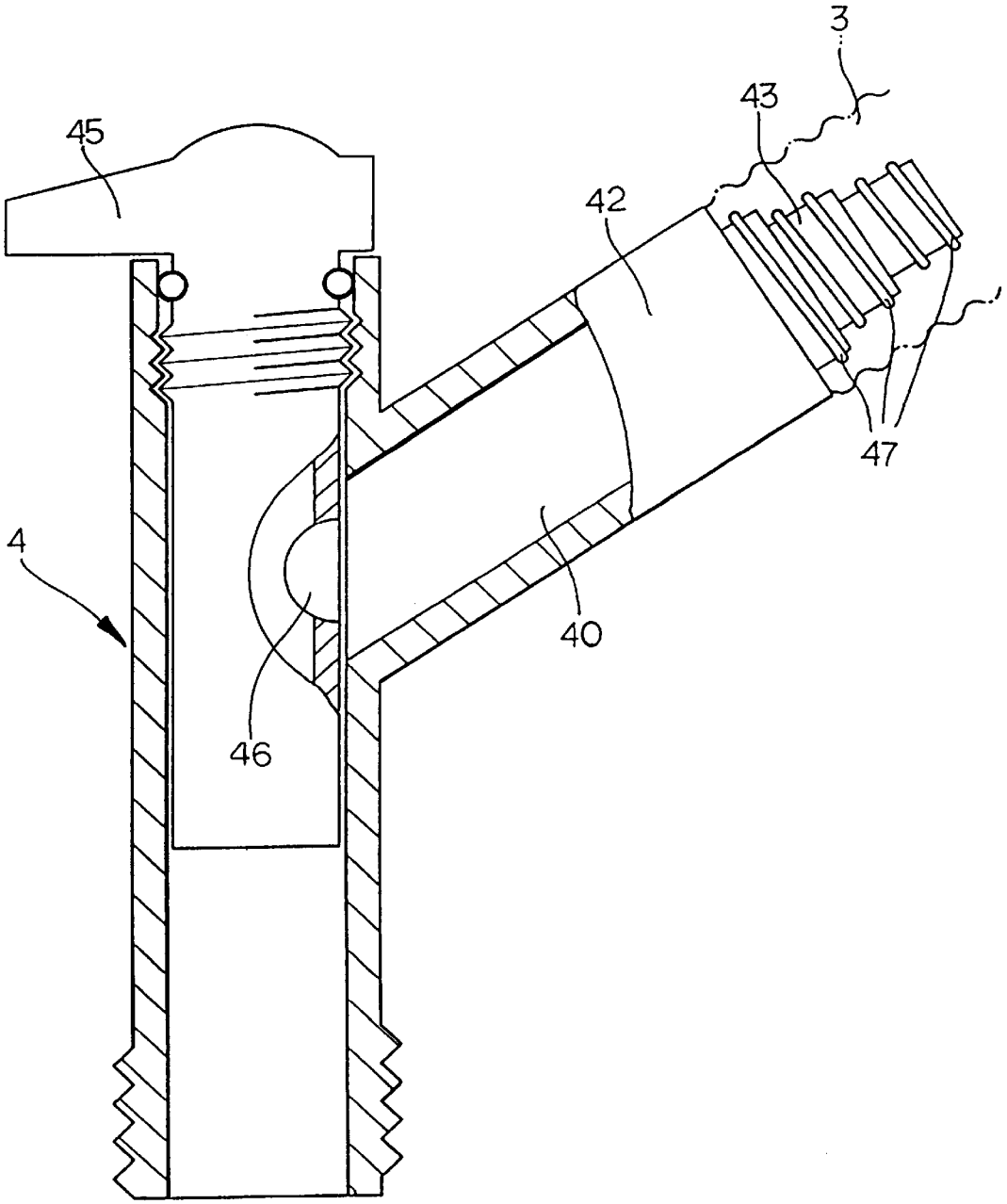
FIG. 4 is a partial longitudinal cross-sectional view taken along line 4—4 of FIG. 2 extending partially along line 3—3 illustrating a water supply control unit for an improved mop with a cleaning cloth according to the present invention.

As shown in FIG. 4, a water supply unit 4 is formed in a gun shape. The water supply unit 4 is provided with a mop rod assembling portion 41 threadedly coupled with the mop rod 1, a hose 3 connected with a water supply tube 42, and a hose assembling portion 43 to which the hose 3 is connected. The water supply control unit 4 includes a lever 45 inserted into an inner path for rotating the lever 45 in clockwise and counterclockwise directions, whereby the water supply control unit 4 communicates with a hole 46 formed in the lever 45, thus supplying/blocking a water flow.

The hose assembling portion 43 of the water supply control unit 4 is formed in multiple tiers, and different hoses having different diameters are more easily connected without using an additional connection member. Protrusions 47 are formed on an outer circumferential surface of the hose assembling portion 43, thus preventing the hose 3 and protrusions 43 from being disassembled from one another.

Figure 8:
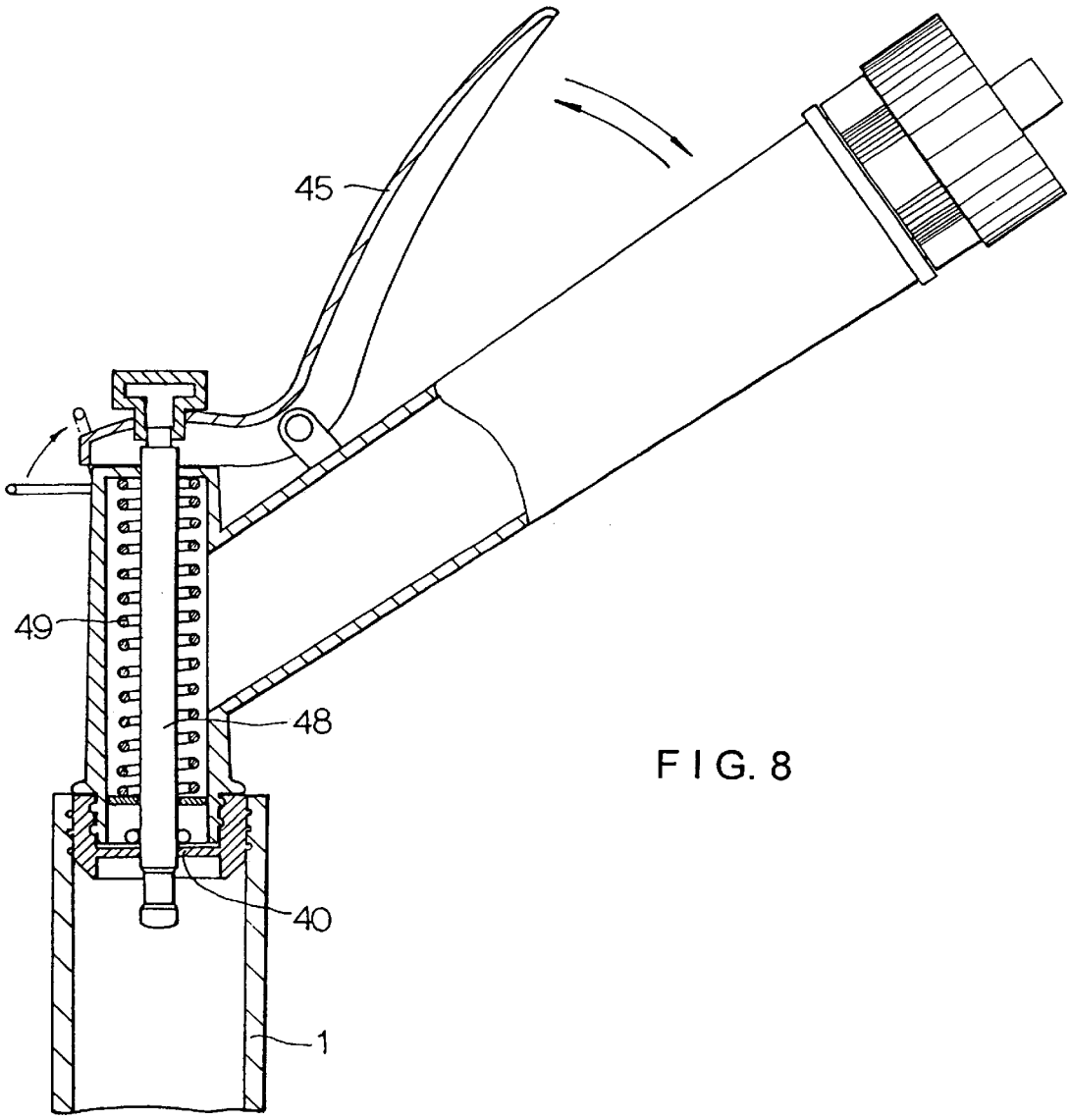
FIG. 8 is a side partial cross-sectional view illustrating a water supply unit for an improved mop with a cleaning cloth according to the present invention.

FIG. 8 illustrates a water supply control unit for controlling a water supplied into the interior of the mop rod 1 according to another embodiment of the present invention.

As shown therein, one end of the lever 45 is pressed without using a rotatable lever which opens or blocks a path 40 of the water supply control unit, whereby a valve 48 which is elastically supported by a spring 49 is backwardly moved, thus opening/blocking the path 40.

Figures 5A, 5B:
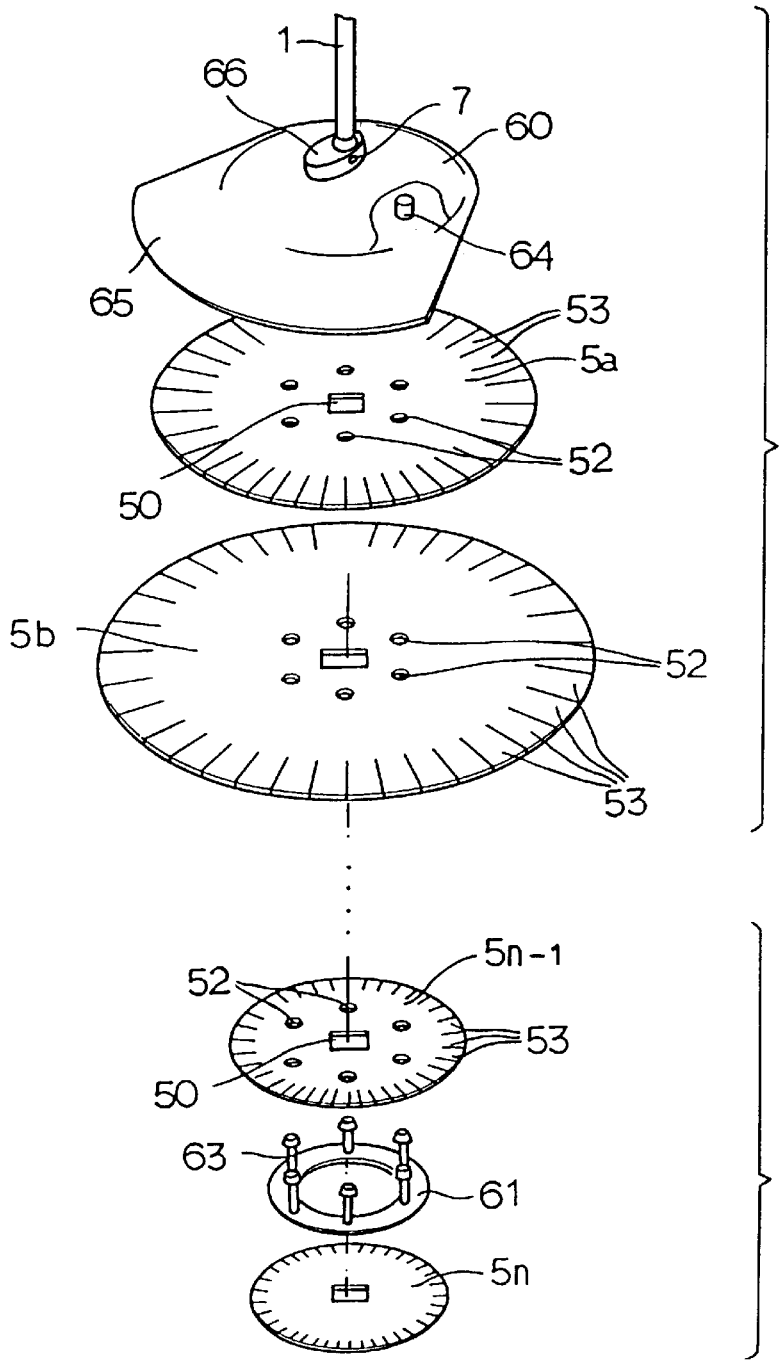
FIG. 5A is an exploded view of an upper member and FIG. 5B is an exploded view of a lower member which when connected together illustrate an improved mop according to the present invention.

As shown in FIGS. 5A and 5B, the mop cloth 5 is formed of a plurality of pieces of cloth which has a good cleaning characteristic and is capable of well absorbing soap bubbles and water. In addition, the mop cloth 5 is formed in a thin plate form with various shapes, for example, the same is formed in a circular shape, rectangular shape, hexagonal shape, octagonal shape, or sunflower shape. The mop cloth 5*a*, 5*b*, . . . , 5*n*−1, 5*n* are stacked by the mop cloth assembling member 6 fixed to the mop rod 1.

A hole 50 is formed in a center portion of each of the mop clothes 5*a*, 5*b*, . . . , 5*n*−1, 5*n*, so that water supplied through the mop rod 1 flows through the hole 50. Wings 53 are formed in an outer circumferential surface of the mop cloth, radially with respect to the center of the mop cloth. In addition, assembling holes 52 are formed in an inner circumferential surface with respect to the center of the hole 50, so that the mop cloths are stacked by using the assembling holes 52.

The mop cloth assembling member 6 is provided with upper (FIG. 5A) and lower (FIG. 5B) members 60 and 61 and lower member 61 is provided with protrusions 63. The protrusions 63 correspond with recessed portions 64 so as to be detachable from each other.

A hand fan-shaped guide 65 is formed in a portion of the upper member 60, so that the mop cloth 5 tightly contacts the floor to be cleaned when cleaning. In addition, with the thusly constituted structure, the edge portions of the mop cloth are prevented from being lifted when cleaning foreign matters attached on a wall due to its own weight. A fixing portion 66 fixed to the mop rod 1 is formed in a center portion thereof, and the mop rod 1 rotates with respect to the shaft pin 7, so that the upper side assembling member 60 and the mop rod 1 are are substantially perpendicular to each other or are made parallel with each other.

In addition, the lower member 61 assembled to the lower portion of the upper member 60 is disposed between the neighboring mop clothes 5*n*−1 and 5*n* for preventing the lower member 61 from scratching the surface to be cleaned. Cloth 5*n* can be attached to cloths 5*n*−*1* by using any suitable and well-known fastening means.

Support protrusions 631 and 641 (see FIG. 6) such as engaging protrusions are formed in the protrusion 63 and the recessed portion 64 formed in the upper and lower members 60 and 61 of the mop cloth assembling member 6, so that the upper and lower members 60 and 61 provided to fix the mop cloth 5 are prevented from escaping by the support protrusions 631 and 641.

In the present invention, a plurality of mop clothes 5*a*, 5*b*, . . . , 5*n*−1, 5*n* which are formed in various shapes, are stacked from one another in a thin plate shape, the lower member for assembling the mop cloth 5 is disposed between the mop cloths 5*n*−1 and 5*n*, so that it is possible to prevent the surface to be cleaned from being scratched during a cleaning.

In addition, since the mop rod 1 is formed of a plurality of mop rods, it is possible to extend or shorten the length of mop rod 1 by inserting the mop rod 1 into a corresponding mop rod, or by separating the mop 1 from the corresponding mop rod. When carrying the mop, the mop rods are disassembled from one another, thus reducing the size of the mop rod.

Furthermore, since the mop cloths 5*a*, 5*b*, . . . , 5*n*−1, 5*n* are made of synthetic material which is capable of well absorbing water, the material thereof is not well pulled out compared to the conventional art, thus preventing some pieces of the mop cloth from being pulled out and scattered. In addition, it is possible to exchange only damaged mop cloth, thus elongating the life span of the mop.

In addition, since the mop rod 1 is extendable by inserting the mop rod into a corresponding mop rod, it is convenient to clean a higher portion of a wall or a longer portion of a floor. After using the mop, the mop rods 1 are disassembled, thus reducing the size of the mop and easily storing the mop.

Furthermore, when connecting the hose 3 to the mop rod 1 and the piped water tube together with the water supply control unit 4, the hollow mop rod 1 acts as one water supply tube. Therefore, since the water is supplied to only a mop cloth which directly contacts with the surface of a wall or a floor to be cleaned, it is possible to clean with only one hand for cleaning and supplying water, and it is possible to prevent water from being scattered, thus reducing the water consumption and significantly increasing cleaning effects.

As described above, since a mop cloth is made of a synthetic material, the improved mop with a cloth according to the present invention is capable of significantly improving a cleaning effect. In addition, the improved mop does not scratch the surface of a wall or a floor to be cleaned during a cleaning, In addition, since there is provided a water supply control unit, the water consumption is significantly reduced.

In addition, since the mop cloths are made in various sizes and shapes and are stacked and used, it is possible to exchange only a damaged mop cloth, thus elongating the life span of the mop. The mop with a cloth according to the present invention is well applicable to cleaning a car body, a truck body, an air plane, and a wall surface of a building.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An improved mop having a plurality of mop rods and a plurality of thin plate-shaped mop cloths which are stacked, wherein each of said mop rods is hollow and has a different diameter, whereby one mop rod is insertable into another mop rod having a complementary size to the one mop rod, thus extending length of the mop rods by inserting with each other; and each of said mop cloths being made of a synthetic material, which is capable of cleaning and absorbing water, a hole through which water is supplied being formed at a portion of each of the mop cloths, and an assembling hole being formed at a portion of each of the mop cloths for assembling the mop cloths, and radially arranged wings being formed in an outer circumferential surface thereof.

2. The mop of claim 1, wherein each of said mop cloths is formed in one of the shape group comprising a circular shape, a rectangular shape, a hexagonal shape, an octagonal shape and a sunflower shape.

3. The mop of claim 1, further comprising;

a fixing portion assembled to one end of the mop rod, one end of the fixing portion being made circular, and a discharge portion through which water is discharged is formed in the end of the fixing portion, and the fixing portion is rotatable with respect to a mop cloth assembling member and is fixed by a shaft pin together with the mop rods, whereby water is always supplied into the interior of the mop cloth assembling member through the discharge portion of the fixing portion even when the mop cloth and the mop rod are substantially perpendicular or are parallel.

4. The mop of claim 3, wherein said mop cloth assembling member includes:

upper and lower members; and recessed portions to which protrusions are detachably engaged, wherein the upper member includes a hand fan-shaped guide, and the lower member defining a fixing member being disposed between two mop cloths.

5. The mop of claim 1, further comprising:

at least one mop rod connection member which is hollow and each said mop rod connection member comprised of two elements having a different diameter;

slits formed by a cutter from end portions of a screw assembling portion, whereby both ends of the mop rod connection member are inwardly narrowed by coupling portions threadedly coupled with the screw assembling portion, thus pressing the outer circumferential surface of each of the mop rods.

6. The mop of claim 1, further comprising:

a water supply unit which is formed in a gun shape and has a mop rod assembling portion and a hose assembling portion for a hose being formed in multiple tiers, said tiers defining a protrusion formed in an outer circumferential surface thereof for preventing the hose from detaching, whereby a water flow path is open/blocked by a lever inserted through the water flow path.

7. An improved mop, comprising:

a plurality of mop rods;

a plurality of thin plate-shaped mop cloths which are stacked by a mop cloth assembling member;

said mop cloth assembling member including:

upper and lower members; and protrusions and recessed portions to which the protrusions are detachably engaged, wherein the upper member includes a hand fan-shaped guide and a fixing member, and the lower member is disposed between two mop cloths.

8. The mop of claim 7, wherein each of said mop clothes is made of a synthetic material which is capable of well cleaning and absorbing water, a hole through which water is supplied, is formed at a portion of each of the mop cloths, and an assembling hole is formed at a portion of each of the mop cloths for assembling the mop cloths, and radially arranged wings are formed in an outer circumferential surface thereof.

9. The mop of claim 8, wherein each of said mop cloths is formed in one of the shape group comprising a circular shape, rectangular shape, a hexagonal shape, an octagonal shape and sunflower shape.

10. The mop of claim 7, wherein each of the mop rods is hollow and has a different diameter, whereby one mop rod is inserted into a corresponding mop rod, thus extending the mop rods length by inserting the mop rods into one another.

11. The mop of claim 7, including a fixing portion assembled to one end of the mop rod, one end of the fixing portion being made circular, and a discharge portion through which water is discharged being formed in the end thereof, and the fixing member being rotatable with respect to the mop cloth assembling member and being fixed by a shaft pin together with the mop rods, whereby water is always supplied into the interior of the mop cloth assembling member through the discharge portion of the fixing portion even when the mop cloth and the mop rod are substantially perpendicular or are parallel.

12. The mop of claim 7, including at least one mop rod connection member, each said mop rod connection member being hollow and comprised of two elements having a different diameter, each said mop rod connection member comprising slits formed by a cutter from end portions of a screw assembling portion, whereby both ends of the mop rod connection member are inwardly narrowed by coupling portions threadedly coupled with the screw assembling portions, thus pressing the outer circumferential surface of each of the mop rods.

13. The mop of claim 7, including a water supply unit formed in a gun shape and having a mop rod assembling portion and a hose assembling portion for a hose, said water supply unit being formed in multiple tiers, each said tier defining a protrusion formed in an outer circumferential surface thereof for preventing the hose from being detached, whereby a water flow path is opened/blocked by a lever inserted through the water flow path.

* * * * *